US010835063B2

(12) United States Patent
Bourgeois

(10) Patent No.: US 10,835,063 B2
(45) Date of Patent: Nov. 17, 2020

(54) HEADREST CUSHION ASSEMBLY FOR NECK PAIN

(71) Applicant: Bryan Bourgeois, Austin, TX (US)

(72) Inventor: Bryan Bourgeois, Austin, TX (US)

( * ) Notice: Subject to any disclaimer, the term of this patent is extended or adjusted under 35 U.S.C. 154(b) by 232 days.

(21) Appl. No.: 15/876,185

(22) Filed: Jan. 21, 2018

(65) Prior Publication Data

US 2018/0368593 A1 Dec. 27, 2018

Related U.S. Application Data

(60) Provisional application No. 62/604,181, filed on Jun. 27, 2017.

(51) Int. Cl.
*A47G 9/10* (2006.01)

(52) U.S. Cl.
CPC ..... *A47G 9/1081* (2013.01); *A47G 9/1009* (2013.01); *A47G 2009/1018* (2013.01)

(58) Field of Classification Search
CPC ..... A47C 21/00; A47C 7/383; A47C 7/405; A47C 7/425; A47C 20/027; A47C 27/148; A47G 9/1081; A47G 9/1009; A47G 2009/1018; A47G 9/109; A47G 9/1072; A61G 7/065; A61G 7/07; A47D 15/006; A45D 15/006
See application file for complete search history.

(56) References Cited

U.S. PATENT DOCUMENTS 3,811,140 A * 5/1974 Burpo ..... A61G 7/065 5/632
5,310,245 A * 5/1994 Lyszczasz ..... A47C 7/383 297/219.12
5,448,790 A * 9/1995 Saro ..... A47C 17/045 5/427
5,727,267 A 3/1998 Keilhauer
6,135,560 A * 10/2000 Fagg ..... A47G 9/007 297/391
6,817,049 B1 11/2004 Hall
8,069,515 B1 12/2011 Tingey
8,661,586 B2 3/2014 Melcher et al.
(Continued)

FOREIGN PATENT DOCUMENTS

CN 202800863 3/2013
CN 103549831 8/2016

OTHER PUBLICATIONS

International Search Report by Russia Patent Office dated Oct. 18, 2018, for PCT/US2018/037451.
(Continued)

*Primary Examiner* — Robert G Santos
*Assistant Examiner* — Alison N Labarge
(74) *Attorney, Agent, or Firm* — Ryuh Patent Law; Steven Yu

(57) ABSTRACT

A headrest assembly for a user to recline thereon. The headrest assembly comprises an upper portion for supporting the user's head and a lower portion for supporting the user's upper back. There is a rigid base that supports the upper and lower portions. At the upper portion, there are one or more upper cushions coupled to the rigid base. The upper cushion(s) are configured to support a user's head. At the lower portion, one or more elongated back support(s) are coupled to the rigid base. Also disclosed are methods for using a headrest assembly.

15 Claims, 9 Drawing Sheets

(56) References Cited

U.S. PATENT DOCUMENTS

| | | | | |
|---|---|---|---|---|
| 9,427,366 | B2 | 8/2016 | Melcher et al. | |
| 9,808,370 | B1 * | 11/2017 | Reser | A61F 5/56 |
| 2011/0056023 | A1 * | 3/2011 | Weeks | A47D 15/008 5/652 |
| 2011/0095582 | A1 * | 4/2011 | Romas | A47C 7/383 297/220 |
| 2017/0156508 | A1 * | 6/2017 | Segal | A47C 27/001 |
| 2017/0246066 | A1 * | 8/2017 | Reilly | A61G 13/08 |

OTHER PUBLICATIONS

Written Opinion by Russia Patent Office dated Oct. 18, 2018, for PCT/US2018/037451.

* cited by examiner

FIG. 1A
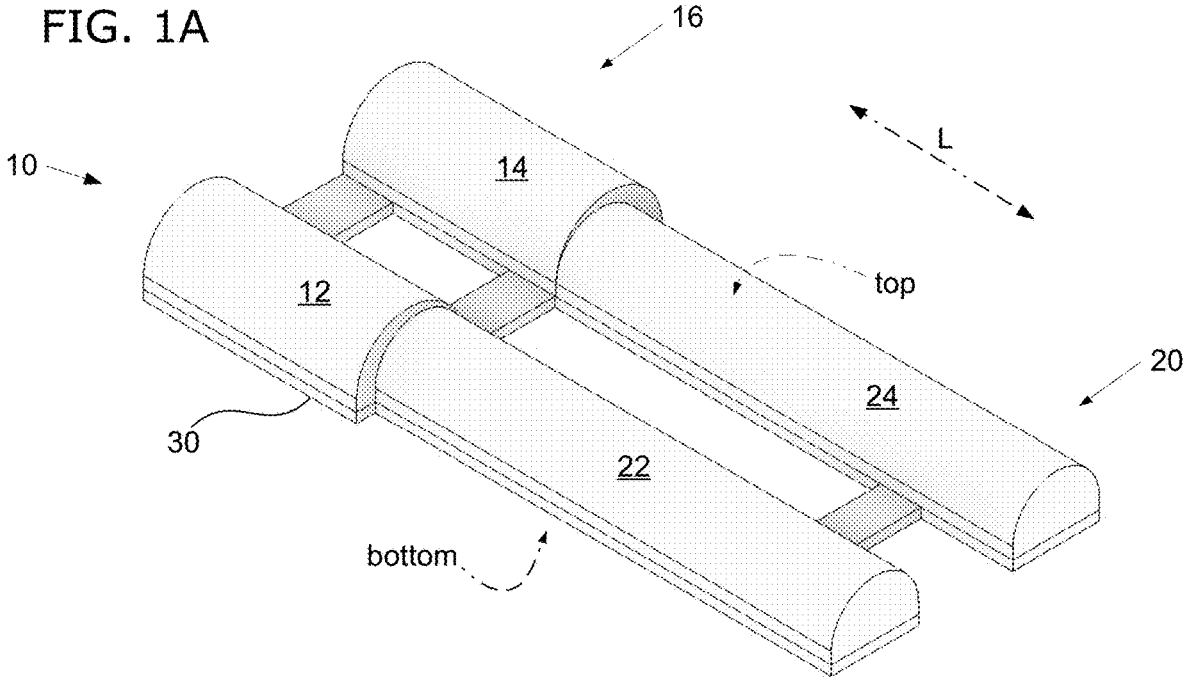
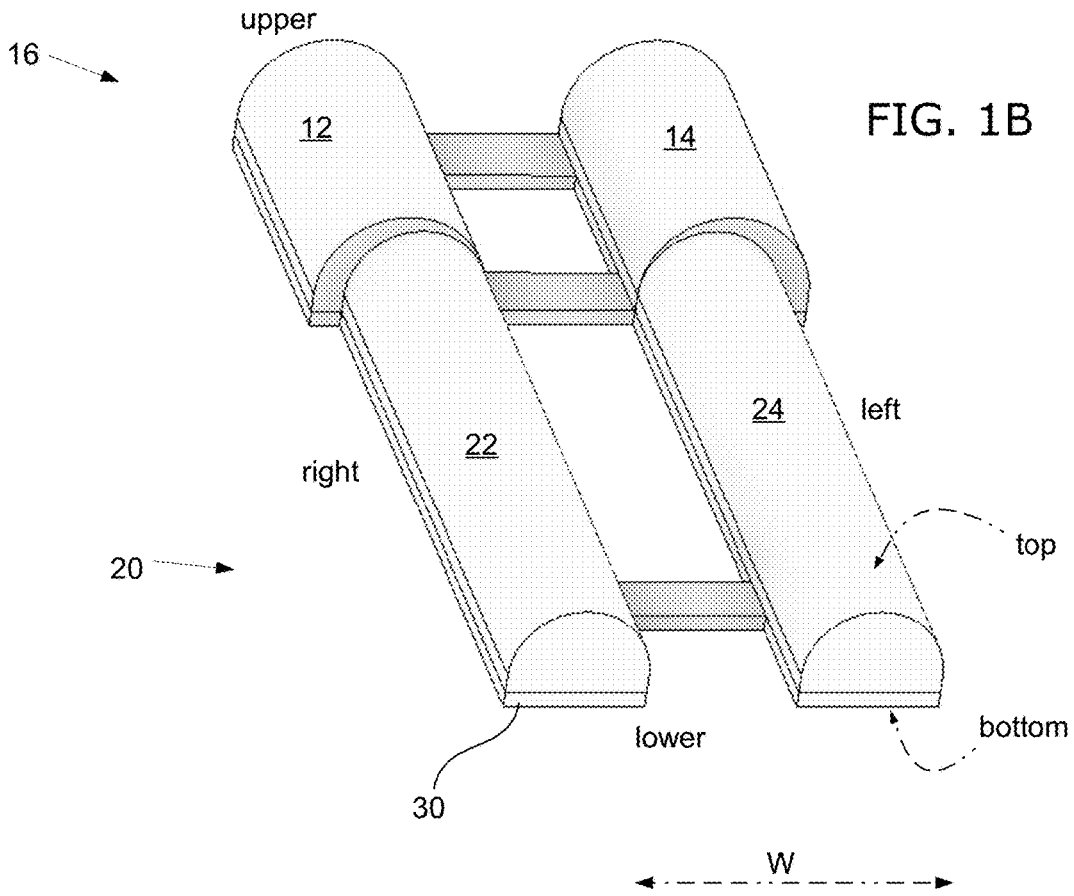
FIG. 1B

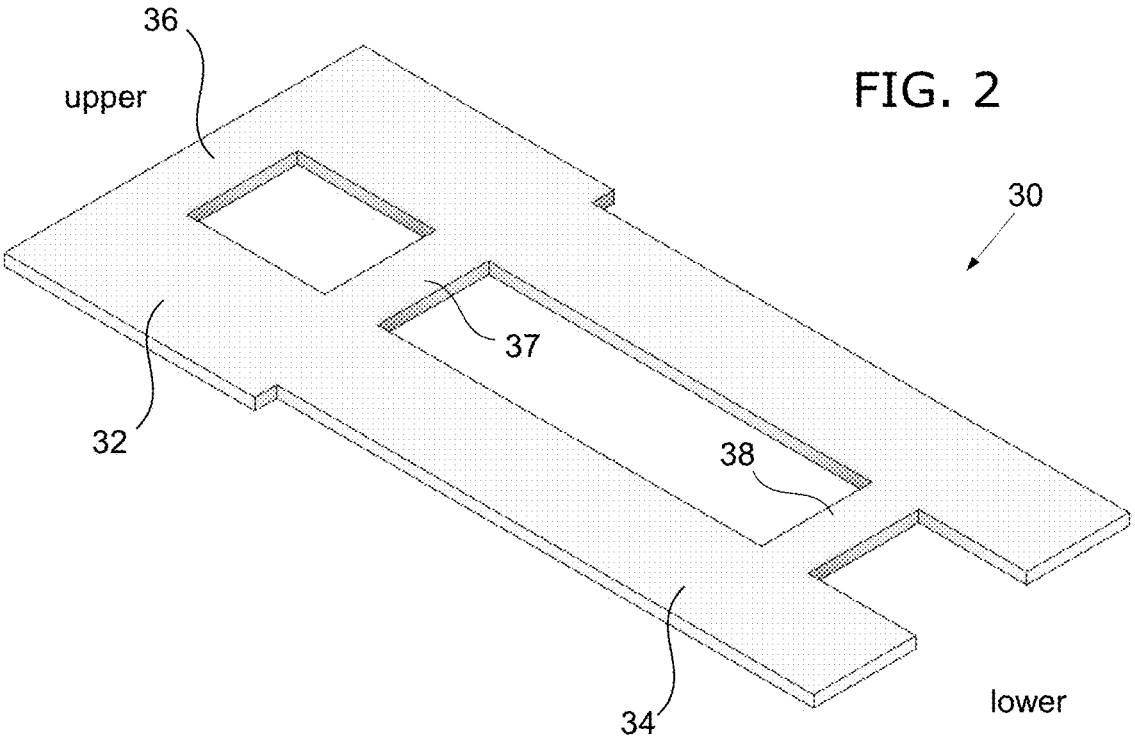
FIG. 2
FIG. 3
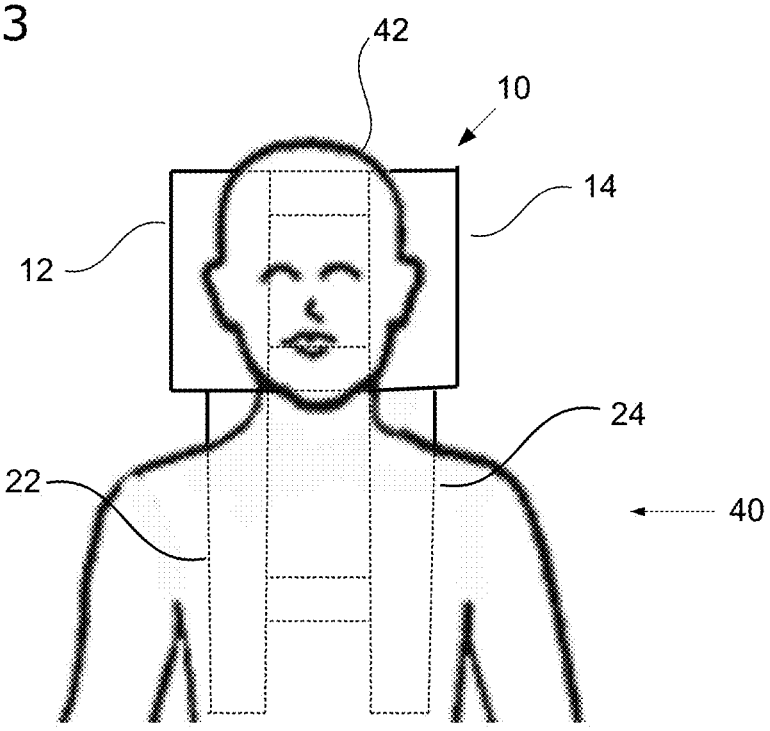

FIG. 9A
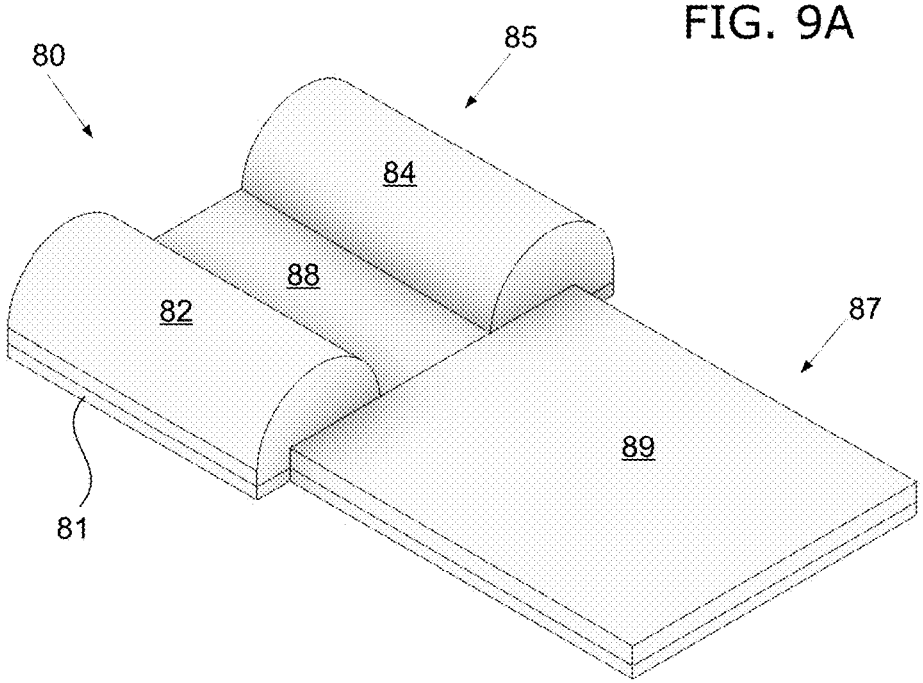
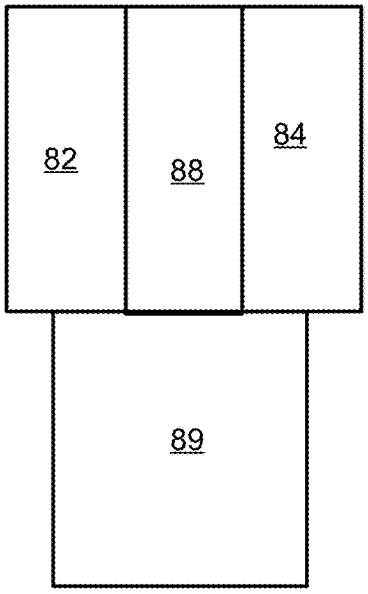
FIG. 9B
FIG. 9C
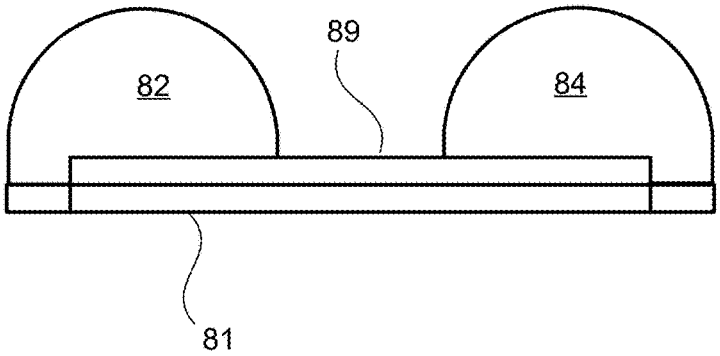

HEADREST CUSHION ASSEMBLY FOR NECK PAIN

TECHNICAL FIELD

This invention relates to pillows, and more particularly to ergonomic cervical pillows designed for alleviating neck pain.

BACKGROUND

The neck has a complex anatomical structure, being made up of numerous muscles, tendons, and cartilage, held together by just seven small bones. These seven bones (cervical vertebrae) make up the upper portion of the spinal column, i.e. the cervical portion of the spine. Although they are relatively small, the bones of the cervical vertebrae are responsible for protecting one of the most vital parts of our anatomy—the spinal cord of the central nervous system, as well as supporting the head and allowing free movement of the head and neck.

The intricate bone and tissue structures of the neck are easily stressed, making them vulnerable to compression or nerve pinching. Neck pain or stiffness can be alleviated by having the head or neck held in better position during sleep. In particular, keeping the neck in line with the head and back during sleep could help to prevent neck pain. But keeping the head, neck, and back in proper alignment requires the right support system.

Because so many people suffer from neck pain, there are a wide variety of pillow products that purport to provide relief to the user. Such specially designed pillows may be called cervical or neck support pillows. But one of the shortcomings of currently-available cervical pillows is that, although they support the user's neck and head, they do not provide adequate support for the upper back. Because of this deficiency, these cervical pillows do not adequately promote proper realignment of the spine in the neck and the upper back, which would release tension and allow the bones to readjust to their proper position. Thus, there is a need for a pillow that provides both head/cervical and upper back support.

SUMMARY

This invention provides a headrest assembly for a user to recline thereon. The headrest assembly of this invention could provide a variety of benefits for the user, such as alleviating neck pain, preventing neck pain during sleep or rest, or improving the quality of sleep. The headrest assembly may operate by supporting the user's upper back along with the head and neck. This may be useful for helping to realign the spine in the neck with the upper back to release tension and allow the bones to readjust to their proper position.

The headrest assembly comprises a rigid base. As used herein, the term "rigid" when referring to the base is defined as an amount of stiffness that is greater than the stiffness of the upper cushion(s) (and optionally, the lower cushions) of the headrest assembly, as further described below. The rigid base should be sufficiently stiff to substantially resist deformation when subjected to the weight of a 70 kilogram adult person reclining on the headrest assembly when laid upon a bed. The rigid base could be made of any suitable material to provide sufficient rigidity.

From a functional perspective, the headrest assembly has an upper portion and a lower portion. The rigid base supports the upper and lower portions. The upper portion is designed to accommodate the user's head. The lower portion is designed to accommodate the user's upper back. The upper portion of the headrest assembly has one or more cushions that are configured to support the user's head. Various parts of the head that may be supported, including the left, left posterior, right, and/or right posterior sides of the user's head. In some embodiments, this function is performed by a single upper cushion that is coupled to the rigid base at its upper portion; in some cases, this cushion has left and right sidewalls.

In some embodiments, the headrest assembly comprises a left upper cushion and a right upper cushion coupled to the rigid base at the upper portion. The left and right upper cushions are separated by a gap; in some cases, the gap is at least 2 cm wide; and in some cases, in the range of 2-15 cm wide. In some cases, the distance between the apexes of the left and right upper cushions is in the range of 12-25 cm.

At the lower portion of the headrest assembly, there are one or more elongated back supports coupled to the rigid base. The elongated back support(s) may be cushion elements, as described above for the upper cushions, or include cushion elements. However, the elongated back support(s) do not necessarily have to be cushions. In some cases, the elongated back supports are rigid, i.e. more rigid than the upper cushion(s). In some embodiments, the elongated back support is a cushion. In some embodiments, the elongated back support is a rigid structure and there is a cushion coupled to the elongated back support.

In some embodiments, there is a single elongated back support at the lower portion of the headrest assembly. In some embodiments, there is a left lower elongated back support and a right lower elongated back support at the lower portion of the headrest assembly. The left and right lower elongated back supports are separated by a gap; in some cases, the gap is at least 2.5 cm wide; and in some cases, in the range of 2.5-15 cm wide. In some cases, the distance between the apexes of the left and right elongated back supports is in the range of 12-25 cm.

In some embodiments, the gap between the left and right lower elongated back supports is different from the gap between the left and right upper cushions. In some cases, the gap between the left and right lower elongated back supports is wider than the gap between the left and right upper cushions.

In some embodiments, the length of the lower elongated back support(s) is at least 25 cm; and in some cases, in the range of 30-90 cm. In some embodiments, the length of the lower elongated back support(s) is at least 40 cm; and in some cases, in the range of 50-90 cm. In some embodiments, the length of the upper cushion(s) is at least 8 cm; and in some cases, in the range of 10-21 cm. The upper cushion(s) or lower elongated back support(s) may have a length that is greater than its width, and thereby have a longitudinal axis. In some cases, the length of such cushion(s) or elongated back support(s) is at least twice its width. For the lower elongated back support(s), in some cases, its length is at least three times its width. In some embodiments, the longitudinal axis of the upper cushion(s) is parallel to the longitudinal axis of the lower elongated back support(s).

In some embodiments, the height of the upper cushion(s) is in the range of 2-10 cm (as measured from the rigid base). As used herein, the term "height" when used in reference to a component of the headrest assembly means the elevation of that component. In some embodiments, the height of the lower elongated back support(s) is in the range of 1-10 cm (as measured from the rigid base). In some embodiments, the height of the upper cushion(s) is higher than the height of the lower elongated back support(s); and in some cases, the height of the upper cushion(s) is at least 1.5 cm higher than the height of the lower elongated back support(s).

In some embodiments, the thickness of the elongated back support(s) at its lower end is less than its thickness at an upper segment of the elongated back support(s). The upper segment is a transverse segment of the elongated back support that is located above (more upwards, towards the user's head) than the lower end. As used herein, the term "thickness" when used in reference to an upper cushion or lower elongated back support means the top-to-bottom elevation.

The upper cushions and lower elongated back supports described above may be coupled onto the rigid base in any suitable manner, including glue, screws, clips, snap fasteners, Velcro hook and loop fasteners, or any other suitable type of fastener. Or in another example, they may be coupled by molding or extrusion as one piece. The coupling with the rigid base does not have to be a direct connection; the coupling may be indirect via another part in between.

In some embodiments, the upper cushion(s) of the headrest assembly are coupled to the rigid base via a hinge or other pivot mechanism. This allows the upper cushion(s) to pivot relative to the rigid base. In some cases, the hinge is located at the upper edge of the upper cushion(s). Any suitable type of hinge can be used, including hinges that can be locked into position. In some cases, the pivot angle is set to greater than 0°; and in some cases, greater than 15°.

The dimensions for the headrest assembly or components thereof may vary depending on a variety of factors, such as the user's age range (e.g. child vs. adult), gender, body weight, body shape, intended anatomical target (e.g. upper back vs. both upper and lower back), etc. In some embodiments, the length of the rigid base (along its vertical or longitudinal axis) is at least 35 cm; and in some cases, in the range of 40-100 cm. In some embodiments, the length of the rigid base is at least 50 cm long; and in some cases, in the range of 50-120 cm long. In some embodiments, the width of the rigid base (along the horizontal axis) at the lower portion of the headrest assembly is less than 40 cm; and in some cases, in the range of 20-35 cm. In some embodiments, the height of the rigid base is less than 4 cm; and in some cases, less than 2.5 cm.

The headrest assembly may be substantially symmetrical along its central vertical or longitudinal axis. The various parts of the headrest assembly may come preassembled or may require some assembly by the user. For example, the rigid base and cushions may be provided separately, requiring assembling together by the user.

In another aspect, the invention provides a method of using a headrest assembly. The method comprises lying supine in a reclined position with the head positioned on the upper portion of the headrest assembly and the upper back positioned on the lower portion of the headrest assembly. The user does not necessarily have to be sleeping. The user may lie on the headrest assembly for any suitable duration of time to relieve neck pain. For example, the user may lie on the headrest assembly intermittently throughout the day for several minutes at a time. In some embodiments, the method further comprises positioning the lower back on the headrest assembly.

In some embodiments, the headrest assembly comprises a left lower elongated back support and a right lower elongated back support, and the method comprises positioning the thoracic spine between the two lower elongated back supports. In some cases, the clavicles of the user's upper back are positioned between the left and right lower elongated back supports. In some embodiments, the upper cushion(s) of the headrest assembly are coupled to the rigid base via a hinge, and the method further comprises adjusting the pivot angle of the upper cushion(s). In some embodiments, the rigid base is sufficiently long to support the user's lower back and the method further comprises positioning the lower back on the lower portion of the headrest assembly. This may be useful in providing lumbar support.

BRIEF DESCRIPTION OF THE DRAWINGS

FIGS. 1A-D show an example of a headrest assembly of the invention. FIG. 1A shows a perspective view; FIG. 1B shows a different perspective view; FIG. 1C shows a side view; FIG. 1D shows a view from the lower end facing towards the upper end.

FIG. 2 shows a perspective view of the rigid base of FIG. 1 in isolation.

FIG. 3 shows an example of how the headrest assembly of FIG. 1 could be used.

FIG. 5A shows a perspective view; FIG. 5B shows a view from the lower end facing towards the upper end.

FIG. 6A shows a side view; FIG. 6B shows a vertically-oriented cross-section view of the headrest assembly.

FIGS. 9A-C show a headrest assembly according to an alternate embodiment. FIG. 9A shows a perspective view; FIG. 9B shows a top view; FIG. 9C shows the view at the lower end.

FIG. 10A shows the headrest assembly in flat position; FIG. 10B shows the headrest assembly with the upper cushion in a raised position.

FIG. 11A shows a side view of the headrest assembly; FIG. 11B shows a view from the lower end facing towards the upper end.

DETAILED DESCRIPTION

To assist in understanding the invention, reference is made to the accompanying drawings to shown by way of illustration specific embodiments in which the invention may be practiced. These embodiments are described in sufficient detail to enable those skilled in the art to practice the invention, and it is to be understood that other embodiments may be used and that structural changes may be made without departing from the scope of the invention. Therefore, the following detailed description is not to be taken in a limiting sense, and the scope of the invention is defined by the appended claims and their equivalents.

Figure 1C:
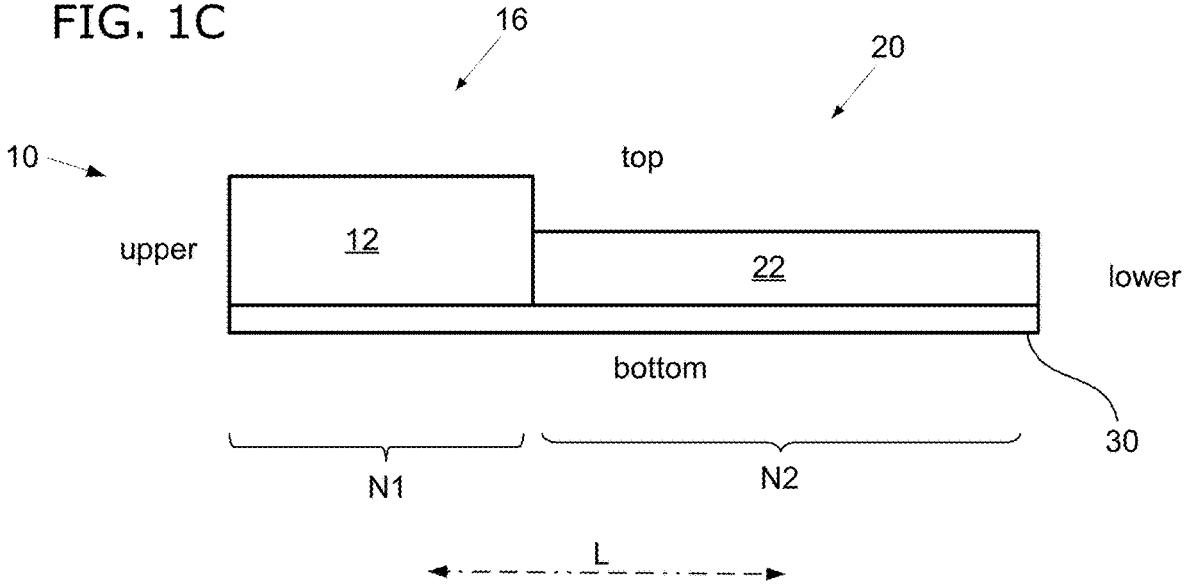

FIGS. 1A-D show an example headrest assembly 10 of the invention. FIGS. 1A and 1B show different perspective views of the headrest assembly 10. Locations on the headrest assembly 10 are defined according to the anatomical orientation of a user lying supine on the headrest assembly 10. As such, "upper" is in the direction of the user's head; "lower" is in the direction of the user's feet; "top" faces in the direction of the user's anterior (front); and "bottom" faces in the direction of the user's posterior (back).

In the drawing figures herein, the labels "upper" indicates the upper end and "lower" indicates the lower end of the headrest assembly 10. The labels "top" indicates the top face and "bottom" indicates the bottom face of the headrest assembly 10. As used herein, "left" and "right" refer to the anatomical left and right sides with respect to the user lying supine on the headrest assembly 10 (not with respect to the top view of the headrest assembly 10). For definition herein, the length of a headrest assembly of the invention or parts thereof is measured along the longitudinal or vertical axis as indicated by the line "L"; and the width of a headrest assembly of the invention or parts thereof is measured along the transverse or horizontal axis as indicated by the line "W."

The headrest assembly 10 comprises an upper portion 16, which is designed to support the user's head and neck. At this upper portion 16, the headrest assembly 10 has a pair of rectangular-shaped cushions, a left side cushion 14 and right side cushion 18. The cushions 14 and 18 are designed to be soft and comfortable to the user. The cushions 14 and 18 may be made of any suitable comfortable padding or contouring material, such as polyurethane foam, styrofoam, polypropylene foam, gel foam, latex, fabric fillers (such as polyester filaments, goose down, feathers, etc.), or microbead fillers.

The headrest assembly 10 further comprises a lower portion 20, which is designed to support the user's upper back. At this lower portion 20, the headrest assembly 10 has another pair of rectangular-shaped cushions, a right lower cushion 22 and a left lower cushion 24. The lower cushions 22 and 24 may or may not have the same composition or design as the upper cushions 14 or 18. The headrest assembly 10 is bilaterally symmetrical (along its central vertical axis).

FIG. 1C shows a side view of the headrest assembly 10. As seen here, the height of the upper cushions 12 and 14 is greater than the height of the lower cushions 22 and 24. In this particular example, the length N1 of the upper cushions is about 13 cm and the length N2 of the lower cushions is about 51 cm. The length of the rigid base 30 is about 65 cm. In an alternate embodiment of the invention, the headrest assembly is designed such that the lower portion extends further towards the pelvis (e.g. crest of the ilium).

Figure 1D:
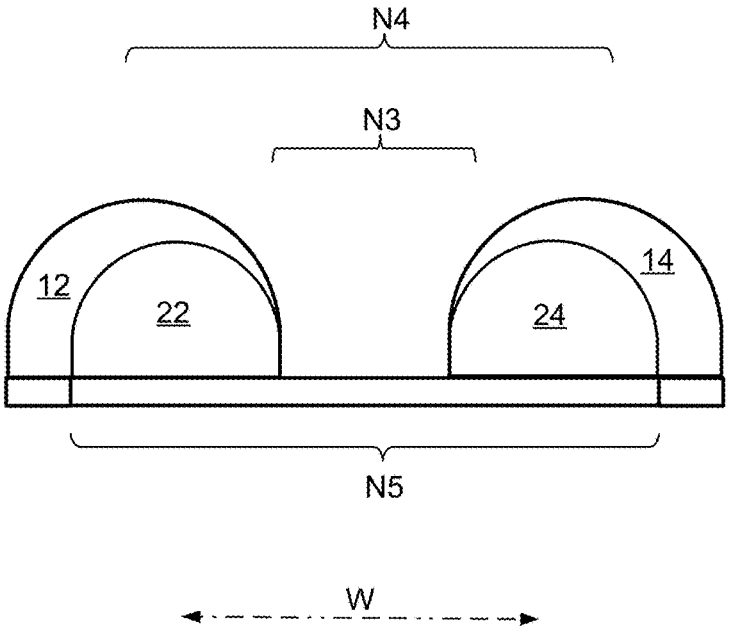

FIG. 1D shows a view from the lower end of the headrest assembly 10 (facing towards the upper end). Seen here are the lower end faces of cushions 12, 14, 22, and 24. In this example embodiment, the width N3 (gap) between the lower cushions 22 and 24 is about 5 cm; the width N4 between the apexes of the upper cushions 12 and 14 is about 18 cm; and the width N5 of the lower portion of the rigid base 30 is about 30 cm. The height difference between the apexes of the lower cushions 22 and 24 and the apexes of the upper cushions 12 and 14 is about 4 cm.

For a better view of the rigid base 30, FIG. 2 shows the rigid base 30 in isolation. Rigid base 30 should be sufficiently stiff to substantially resist deformation when subjected to the weight of an adult person reclining on the headrest assembly. The rigidity of the rigid base 30 can be defined as being more rigid than any of cushions 12, 14, 22, and 24. The rigid base 30 can be constructed of any suitable rigid material such as plastic, metal, or wood. Moreover, the rigid base 30 can be designed to have any suitable shape or geometry to impart rigidity by virtue of its structural configuration. To reduce its weight or improve comfort, the thickness of the rigid base 30 can be less than 5 cm; and in some cases, less than 3 cm. As seen here, the rigid base 30 has an upper portion 32 and a lower portion 34. The rigid base 30 has a right side and a left side that are symmetrical (along its central vertical axis). Connecting the left and right sides are upper connecting bar 36, middle connecting bar 37, and lower connecting bar 38.

FIG. 3 shows an example of how the headrest assembly 10 could be used. A user 40 is reclining on top of the headrest assembly 10 in a supine position. The user's head 42 and neck are positioned between the upper cushions 12 and 14, which laterally support the user's head 42 and neck. The user's upper back is supported by lower cushions 22 and 24. The user's thoracic spine may be positioned between the lower cushions 22 and 24. It may also be possible for the user's clavicles of the upper back to be positioned between the lower cushions 22 and 24.

Figure 4A:
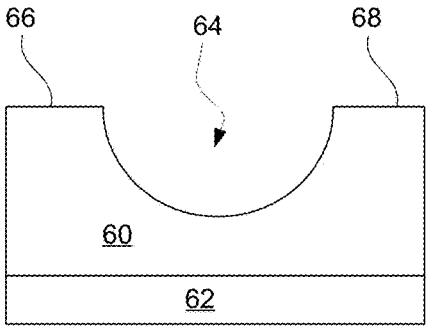
FIGS. 4A-C show alternate examples of how the upper portion of the headrest assembly could be configured, as viewed at the upper end.
Figure 4B:
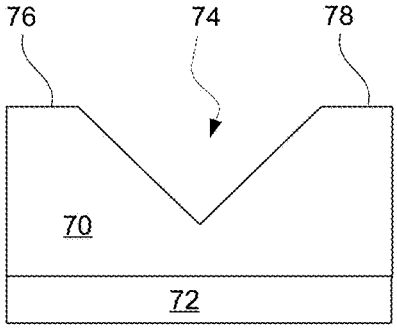
Figure 4C:
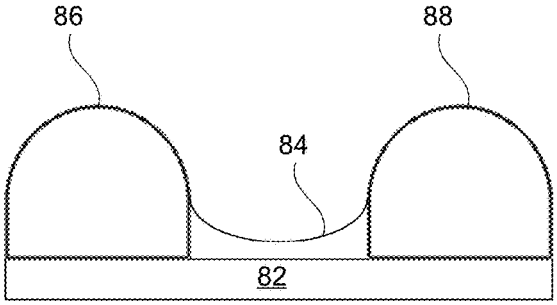

The upper portion of the headrest assembly of the invention could be configured in any suitable way to provide support for the user's head. FIGS. 4A-C show alternate examples of how the upper portion of the headrest assembly could be configured. In the example shown in FIG. 4A (upper end view looking downwards towards the lower end), the upper portion of the headrest assembly has only a single head-supporting cushion 60 mounted on the rigid base 62. The cushion 60 has a concave depression 64 in the middle to conform to the user's head and two sidewalls 66 and 68 to bilaterally support the user's head. In the example shown in FIG. 4B (upper end view looking downwards towards the lower end), the upper portion of the headrest assembly has only a single head-supporting cushion 70 with a "V"-shaped cutout 74 in the middle to conform to the user's head and two sidewalls 76 and 78 to bilaterally support the user's head. In the example shown in FIG. 4C (upper end view looking downwards towards the lower end), the upper portion of the headrest assembly has two cushions 86 and 88, left and right, mounted on a base 82. In the gap between cushions 86 and 88, there is a middle cushion 84 to help support the back of the user's head.

Figure 5B:
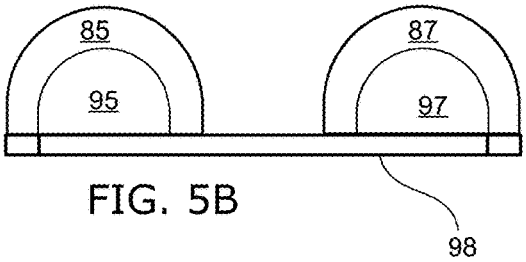
FIGS. 5A and 5B show an alternate embodiment of a headrest assembly of the invention.
Figure 5A:
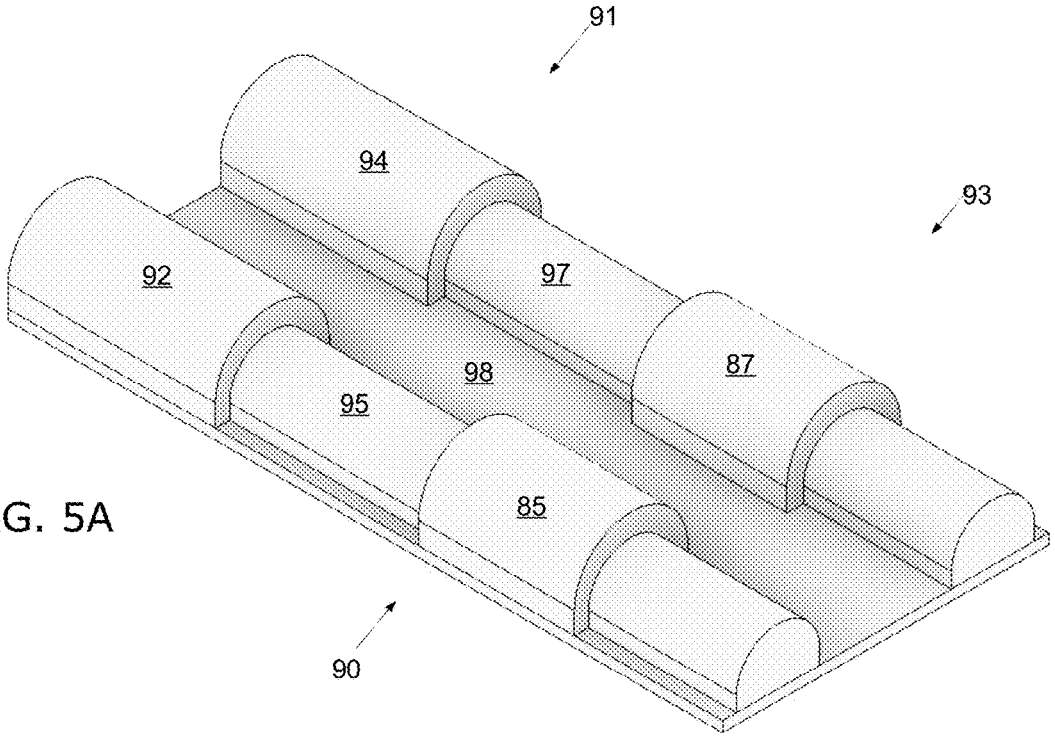

FIGS. 5A and 5B shows another embodiment of a headrest assembly. In this headrest assembly 90, there is a simple rectangular shaped rigid base 98. The headrest assembly 90 is divided into an upper portion 91 and a lower portion 93. A pair of head-supporting upper cushions 92 and 94 are mounted on the base 98. On the lower portion, a pair of rigid back supports 95 and 97 made of a hard plastic are mounted on the base 98. The rigid back supports 95 and 97 have greater stiffness (more rigid) than the upper cushions 92 and 94. To provide cushioning for the lower back, there are two lower cushions 85 and 87 mounted on the rigid back supports 95 and 97. FIG. 5B shows a view from the lower end of the headrest assembly 90 (facing towards the upper end). As seen in this view, the lower cushions 85 and 87 cover over the pair of rigid back supports 95 and 97.

Figure 6A:
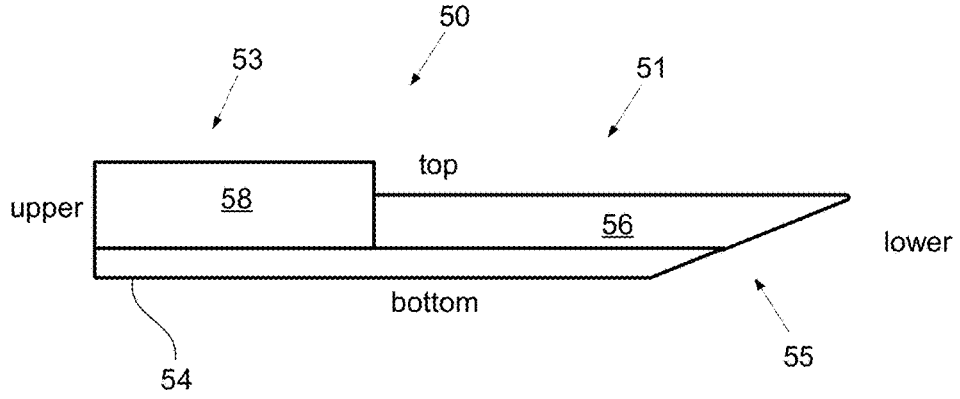
FIGS. 6A and 6B show an alternate embodiment of a headrest assembly of the invention.
Figure 6B:
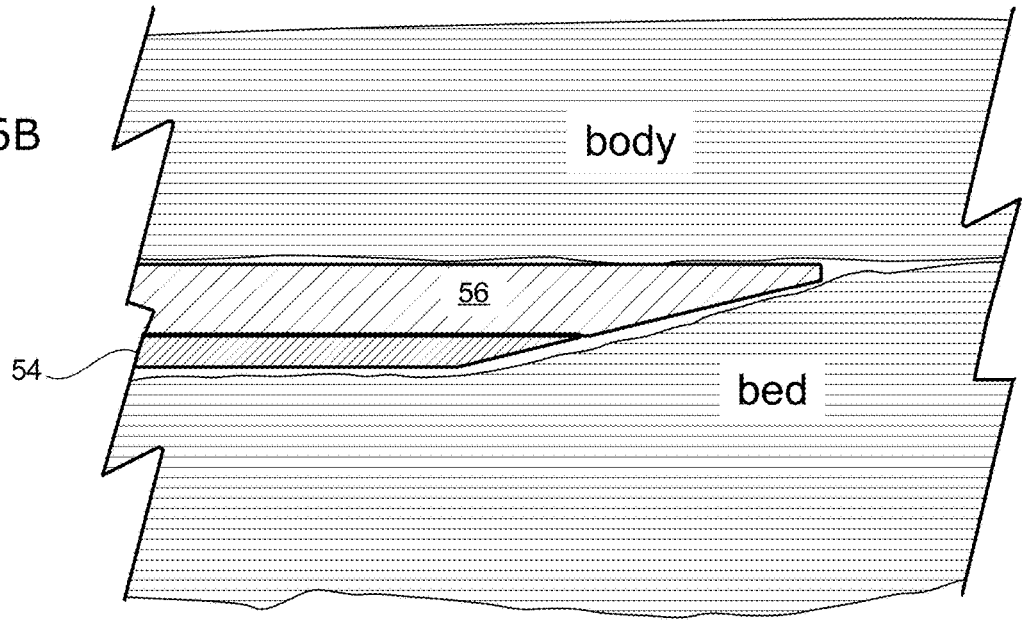

FIGS. 6A and 6B show an alternate embodiment of a headrest assembly of the invention. FIG. 6A shows a side view of the headrest assembly 50, which has an upper portion 53 and a lower portion 51. Headrest assembly 50 is constructed on a rigid base 54 and mounted thereon are a right upper cushion 58 and a right lower cushion 56. The left side cushions are not visible in this side view. The lower end of the lower portion 51 has a wedge-like shape 55. As seen in FIG. 6B, this wedge-like shape 55 is useful for making the top surface of the lower cushion 56 more level with the bed. By moderating the body's transition from the headrest assembly 50 to the bed, this may provide a more comfortable experience for the user.

Figure 7:
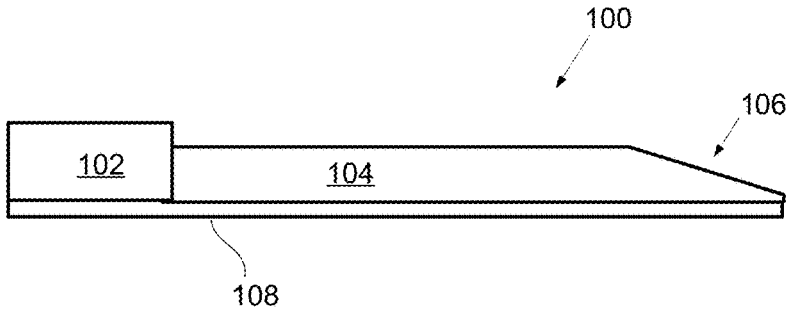
FIG. 7 shows a side view of an alternate embodiment of a headrest assembly of the invention.
Figure 8:
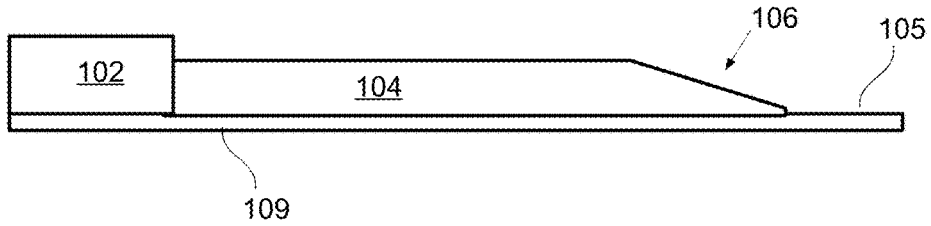
FIG. 8 shows a side view of an alternate embodiment of a headrest assembly of the invention.

FIG. 7 shows a side view of a headrest assembly 100, which is a variation of the headrest assembly 50 above. This headrest assembly 100 is constructed on a rigid base 108 and mounted thereon are a right upper cushion 102 and a right lower cushion 104. The left side cushions are not visible in this side view. The lower cushion 104 is sufficiently long to support the user's lower back. The lower end of the headrest assembly 100 has a wedge-like shape 106, which is made by shaping lower cushion 104 with a tapered end. This configuration can be useful for accommodating the curvature at the lower back. FIG. 8 shows a variation of the headrest assembly 100 above. In this variation, the rigid base 109 extends past the lower cushion 104 to provide a support surface 105 for the user's buttocks.

FIGS. 9A-C show a headrest assembly 80 according to an alternate embodiment. FIG. 9A shows a perspective view of the headrest assembly 80. At the upper portion 85 of the headrest assembly 80, there are a pair of left and right upper cushions 82 and 84 mounted on a rigid base 81. In between the left upper cushion 82 and the right upper cushion 84, there is a centrally-located cushion 88 also mounted on the rigid base 81. This centrally-located cushion 88 helps to support the back of the user's head.

Extending down from the upper portion 85 is a lower portion 87 of the headrest assembly 80. At the lower portion 87, instead of a pair of lower cushions, there is a single back support cushion 89 mounted on the rigid base 81. FIG. 9B shows a top view of the headrest assembly 80, showing the left upper cushion 82, the right upper cushion 84, the centrally-located cushion 88, and the back support cushion 89. FIG. 9C shows a view of lower end of the headrest assembly 80 (facing towards the upper end). Seen here are the lower end faces of the left upper cushion 82, the right upper cushion 84, and the back support cushion 89.

Figure 10A:
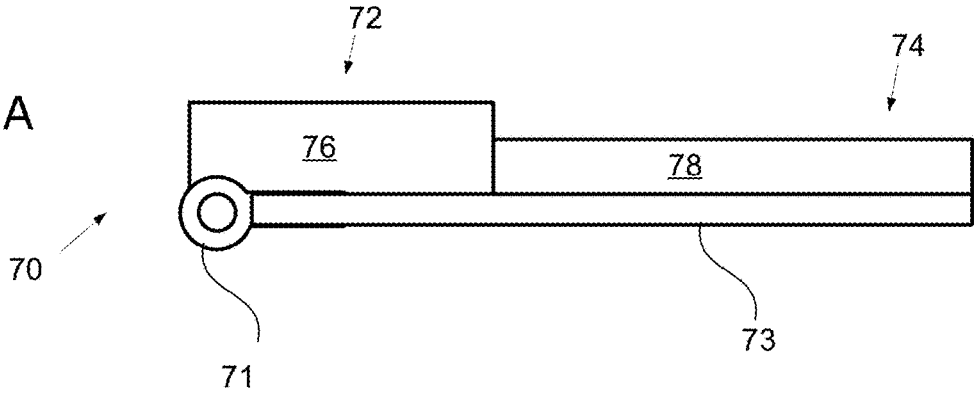
FIGS. 10A and 10B show side views of an alternate embodiment of a headrest assembly of the invention.
Figure 10B:
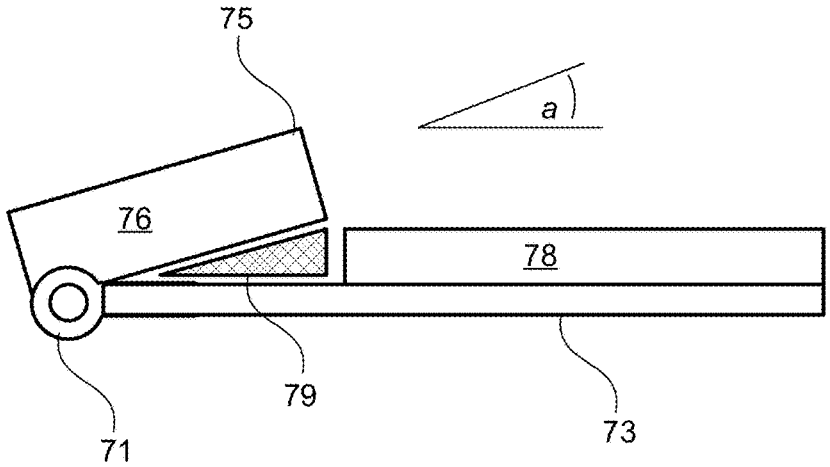

FIGS. 10A and 10B show side views of an alternate embodiment of a headrest assembly. Here, the headrest assembly 70 has an upper portion 72 and a lower portion 74. At the upper portion 72, there is a right upper cushion 76 mounted on a rigid base 73. At the lower portion, there is a right lower cushion 78 mounted on the rigid base 73. The left side cushions are not visible in this side view. The upper cushion 76 is mounted onto the rigid base 73 via a hinge 71 at the upper edge of the upper cushion 76. As seen in FIG. 10B, this configuration allows the upper cushion 76 to be swiveled on the hinge 71. For a user reclining thereon, the user's neck is stretched in extension and additionally, the jutting corner edge 75 of the upper cushions provides additional support to the neck.

As used herein, the term "pivot angle" means the angle between the upper cushion 76 and the rigid base 73. FIG. 10A shows the headrest assembly 70 in flat position with the pivot angle at substantially 0°. FIG. 10B shows the headrest assembly 70 with the upper cushion 76 raised such that the pivot angle "a" is greater than 0°. In the example shown in this figure, the upper cushion 76 is kept in the raised position by inserting a wedge 79 beneath it. The height of the wedge 79 may be in the range of 1-4 cm (to its apex), but other heights are also possible. In other embodiments, the headrest assembly 70 could have other mechanisms to keep upper cushion 76 in raised position. For example, the hinge 71 could have a locking mechanism to hold the pivot angle.

Figure 11A:
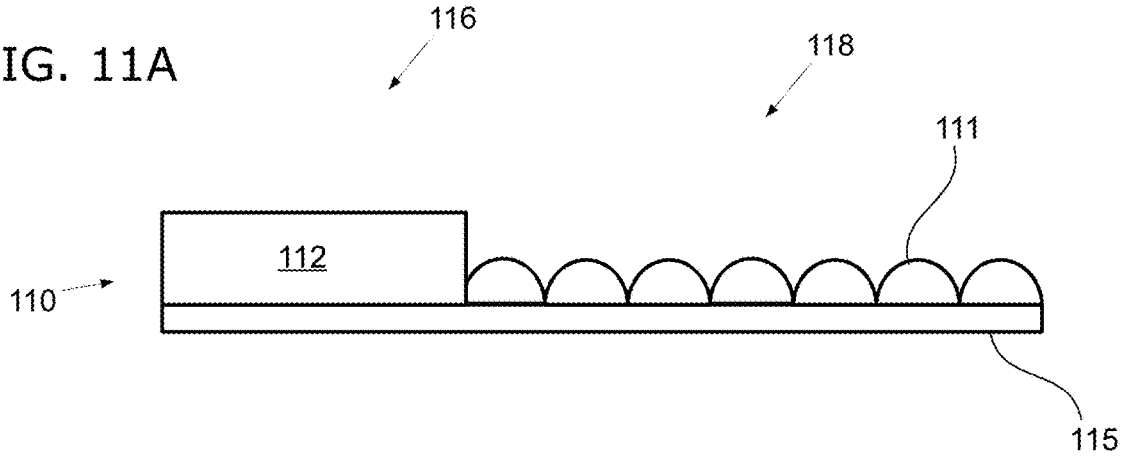
FIGS. 11A and 11B show an alternate embodiment of a headrest assembly of the invention.
Figure 11B:
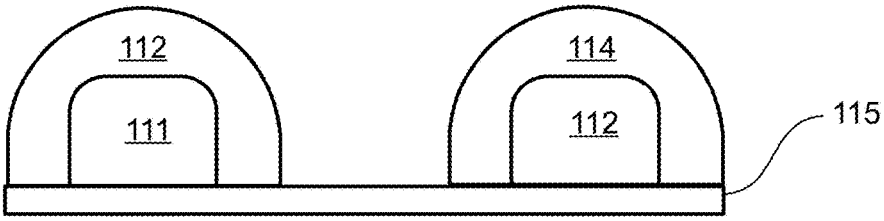

FIGS. 11A and 11B show side views of another example of a headrest assembly. Here, the headrest assembly 110 has an upper portion 116 and a lower portion 118. At the upper portion 116 of the headrest assembly 110, there is an upper right cushion 112 mounted on the rigid base 115. At the lower portion 118, cushioning is provided by a linear series of bumps 111 mounted onto a rigid base 115. FIG. 11B shows a view from the lower end of the headrest assembly 110 (facing towards the upper end). Seen in this view are the upper right cushion 112 and its corresponding upper left cushion 114, along with the left series of bumps 111 and its corresponding right series of bumps 112. The height of the bumps 111 and 112 may be in the range of 1-6 cm (from the rigid base 115), but other heights are also possible.

Figure 12:
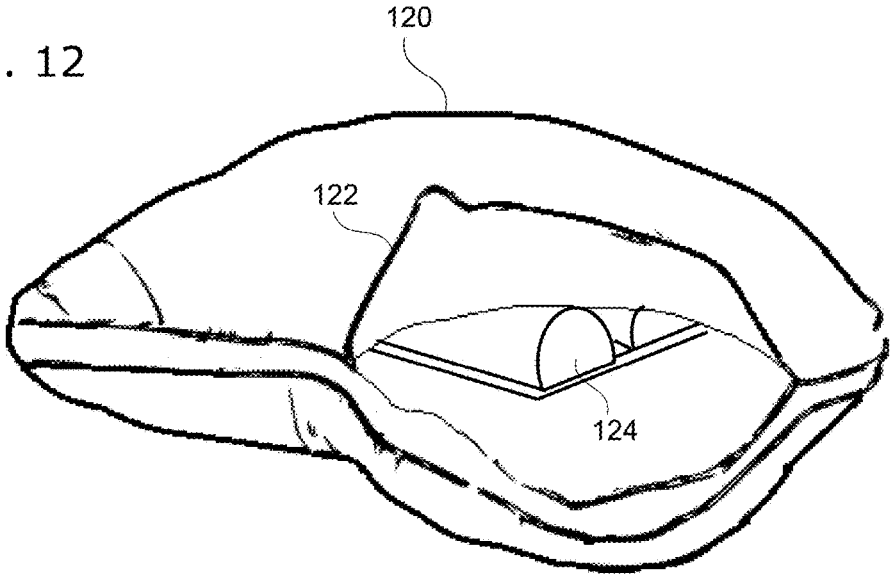
FIG. 12 shows an example of how a headrest assembly could be used in conjunction with a pillow.

The headrest assembly of the invention could be used in conjunction with bedding items such as pillows, blankets, comforters, pillow cases, slipcovers, etc. For example, FIG. 12 shows a headrest assembly 124 enclosed within a well-padded pillow 120 to provide more comfortable cushioning for the user. Pillow 120 can be opened along a zippered flap 122 to allow removal or insertion of the headrest assembly 124. The headrest assembly 124 and the pillow 120 could be provided preassembled, or could be provided separately for assembly by the user.

Figure 13:
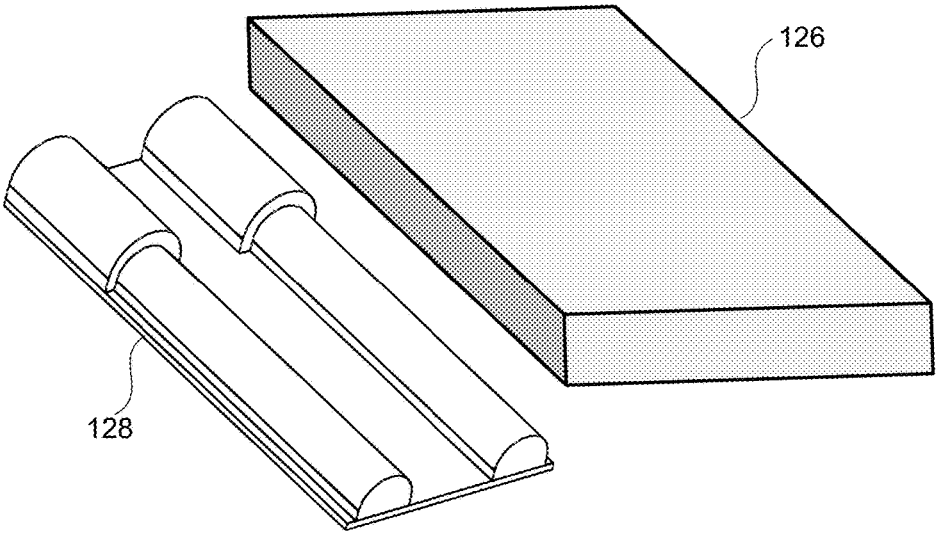
FIG. 13 shows an example of how a headrest assembly could be used in conjunction with a memory foam mat.
Figure 14:
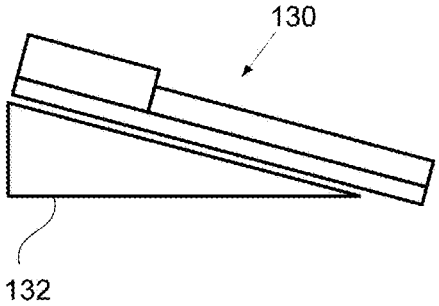
FIG. 14 shows an example of how a headrest assembly could be used in conjunction with a foam wedge pillow.

In another example, FIG. 13 shows a headrest assembly 128 in combination with a thick memory foam mat 126 or other cushion material. By placing memory foam mat 126 over the headrest assembly 128, additional comfort may be achieved. The memory foam mat 126 may have variable height for the upper portion relative to the lower portion. In another example, FIG. 14 shows a headrest assembly 130 in combination with a foam wedge pillow 132. The height of the wedge 132 may be in the range of 10-21 cm (to its apex), but other heights are also possible. This configuration elevates the user's head, which can be useful for relieving gastroesophageal reflux or congestive heart failure.

Figure 15:
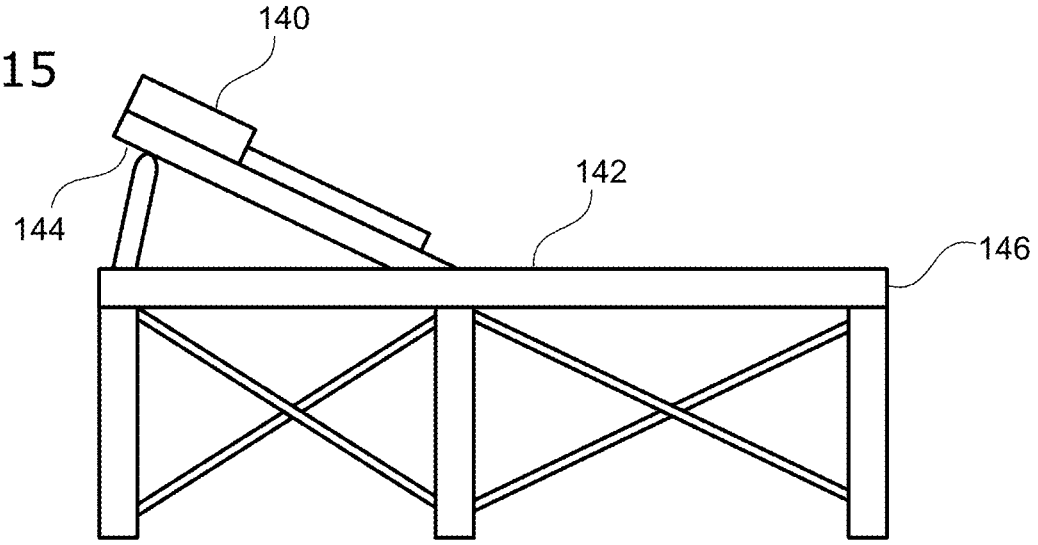
FIG. 15 shows a physical therapy table having a headrest assembly mounted thereon.
Figure 16:
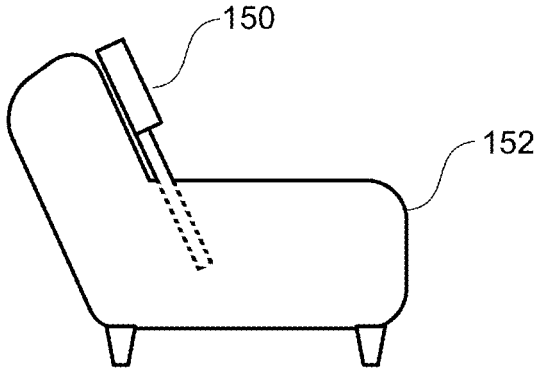
FIG. 16 shows a home armchair with a headrest assembly mounted thereon.

In another aspect, the invention is an article of furniture that comprises a headrest assembly. Examples of furniture encompassed by the invention include beds, chairs, reclining tables, etc. For example, FIG. 15 shows a physical therapy table 142 having a headrest assembly 140 mounted thereon. The user reclines on the table 142 and rests the head and upper back on the headrest assembly 140. The head 144 of the table 142 can be raised or lowered to adjust the incline angle. The foot 146 of the table 142 could also made to provide an adjustable incline. In another example, FIG. 16 shows a home armchair 152 with a headrest assembly 150 mounted thereon. The user sits on the armchair 152 and rests the head and upper back on the headrest assembly 150.

The foregoing description and examples have been set forth merely to illustrate the invention and are not intended to be limiting. Each of the disclosed aspects and embodiments of the invention may be considered individually or in combination with other aspects, embodiments, and variations of the invention. In addition, unless otherwise specified, the steps of the methods of the invention are not confined to any particular order of performance. Modifications of the disclosed embodiments incorporating the spirit and substance of the invention may occur to persons skilled in the art, and such modifications are within the scope of the invention.

Any use of the word "or" herein is intended to be inclusive and is equivalent to the expression "and/or," unless the context clearly dictates otherwise. As such, for example, the expression "A or B" means A, or B, or both A and B. Similarly, for example, the expression "A, B, or C" means A, or B, or C, or any combination thereof.

The invention claimed is:

1. A method of using a headrest assembly, wherein the headrest assembly comprises:

an upper portion;

a lower portion;

a rigid base that supports the upper and lower portions, and is sufficiently long to support the user's lower back;

at the upper portion, one or more upper cushions coupled to the rigid base, that are configured to support a user's head;

at the lower portion, a left lower cushion and a right lower cushion, both being coupled to the rigid base, wherein the height of the one or more upper cushions is higher than the height of the two lower cushions, as measured relative to the rigid base;

wherein the method comprises the user lying supine in a reclined position with the head positioned on the upper portion of the headrest assembly, and both the user's upper and lower back positioned on the two lower cushions, but the headrest assembly does not support the user's entire body; and wherein the rigid base is more rigid than the one or more upper cushions;

wherein each of the two lower cushions comprises a portion of reduced thickness in which the thickness at the lower end is less than the thickness at an upper segment;

and wherein the method further comprises positioning the user's lower back or buttock at the portion of reduced thickness.

2. The method of claim 1, wherein the one or more upper cushions are coupled to the rigid base via a hinge or pivot mechanism, and the method further comprises adjusting the pivot angle of the one or more upper cushions.

3. The method of claim 2, wherein the pivot angle of the one or more upper cushions is adjusted to greater than 0°.

4. The method of claim 1, wherein the user's thoracic spine is positioned between the left and right lower cushions.

5. The method of claim 4, wherein the left and right clavicles of the user's upper back are positioned between the left and right lower cushions.

6. The method of claim 1, wherein at the upper portion, the one or more upper cushions comprise a left upper cushion and a right upper cushion that are separated by a gap.

7. The method of claim 1, wherein at the upper portion, the one or more upper cushions consists of a single upper cushion having left and right sidewalls.

8. The method of claim 1, wherein the length of the rigid base is at least 35 cm.

9. The method of claim 8, wherein the length of each of the two lower cushions is at least 25 cm.

10. The method of claim 1, wherein the width of the rigid base at the lower portion is less than 40 cm.

11. The method of claim 1, wherein each of the two lower cushions has a length that is greater than its width, and wherein each of the two lower cushions has a longitudinal axis.

12. The method of claim 11, wherein the one or more upper cushions have a length that is greater than its width, and wherein the one or more upper cushions have a longitudinal axis.

13. The method of claim 12, wherein the longitudinal axis of the one or more upper cushions is aligned parallel to the longitudinal axis of the two lower cushions.

14. The method of claim 1, wherein the thickness of the rigid base is less than 5 cm.

15. The method of claim 14, wherein the thickness of the rigid base is less than 3 cm.

* * * * *